US011559808B2

(12) United States Patent
Huang et al.

(10) Patent No.: US 11,559,808 B2
(45) Date of Patent: Jan. 24, 2023

(54) MICROFLUIDIC DEVICE

(71) Applicant: CytoAurora Biotechnologies, Inc., Zhubei (TW)

(72) Inventors: Chung-Er Huang, Zhubei (TW); Hsin-Cheng Ho, Zhubei (TW); Sheng-Wen Chen, Zhubei (TW); Ming Chen, Zhubei (TW)

(73) Assignee: CytoAurora Biotechnologies, Inc.

( * ) Notice: Subject to any disclaimer, the term of this patent is extended or adjusted under 35 U.S.C. 154(b) by 557 days.

(21) Appl. No.: 16/814,138

(22) Filed: Mar. 10, 2020

(65) Prior Publication Data

US 2020/0384468 A1 Dec. 10, 2020

(30) Foreign Application Priority Data

Jun. 5, 2019 (TW) ..... 108119451

(51) Int. Cl.
*B01L 3/00* (2006.01)

(52) U.S. Cl.
CPC . *B01L 3/502761* (2013.01); *B01L 2200/0652* (2013.01); *B01L 2300/0645* (2013.01); *B01L 2300/0851* (2013.01); *B01L 2300/0858* (2013.01); *B01L 2300/0861* (2013.01); *B01L 2300/161* (2013.01)

(58) Field of Classification Search
CPC ..... B01L 3/50273; B01L 3/5027; B01L 2200/027; B01L 2300/0681
See application file for complete search history.

(56) References Cited

U.S. PATENT DOCUMENTS 10,386,276 B2 * 8/2019 Gifford ..... G01N 1/34
2012/0103903 A1 5/2012 Hill
2015/0362413 A1 * 12/2015 Zhang ..... B01L 3/502753 210/801

FOREIGN PATENT DOCUMENTS

TW 201905194 A 2/2019
TW M583849 9/2019

OTHER PUBLICATIONS

Search Report appended to an Office Action, which was issued to Taiwanese counterpart application No. 108119451 by the TIPO dated Feb. 24, 2020, with an English translation thereof.
Nezihi Murat Karabacak, et al., "Microfluidic, marker-free isolation of circulating tumor cells from blood samples", Nature Protocols 9 (2014), pp. 694-710.

* cited by examiner

*Primary Examiner* — Brian J. Sines
(74) *Attorney, Agent, or Firm* — Fish & Richardson P.C.

(57) ABSTRACT

A microfluidic device includes a lower casing and an upper casing covering the lower casing. The lower casing includes a lower base wall having a top surface and a plurality of spaced-apart columns that protrude upwards from the top surface. The upper casing includes an upper base wall. A first gap between the upper base wall and a column top surface of each of the columns is large enough to permit passage of large biological particles of a liquid sample, and a second gap between any two adjacent ones of the columns is not large enough to permit passage of the large biological particles and is large enough to permit passage of small biological particles of the liquid sample.

10 Claims, 8 Drawing Sheets

MICROFLUIDIC DEVICE

CROSS-REFERENCE TO RELATED APPLICATION

This application claims priority of Taiwanese Invention Patent Application No. 108119451, filed on Jun. 5, 2019.

FIELD

The disclosure relates to a microfluidic device, more particularly to a microfluidic device with filtering and capturing functions.

BACKGROUND

A conventional microfluidic device is for a liquid sample (e.g. blood) to be detected to flow through internal microstructures thereof, and aims to capture specific biological particles in the liquid sample, or to separate/filter biological particles of a specified size.

In "Microfluidic, marker-free isolation of circulating tumor cells from blood samples" published in Nature Protocols 9, 694-710 (2014) by Karabacak et al. (thereinafter referred to as Karabacak), technical procedures to separate/filter cells of a specified size from blood samples to obtain circulating tumor cells (CTCs) is disclosed. Karabacak uses a deterministic lateral displacement (DLD) procedure, an inertial focusing procedure, and a magnetophoresis procedure to explore the technique for separating marker-free CTCs from the blood sample, wherein by using two stages of the magnetophoresis procedure and negative enrichment of white blood cell, a yield of 97% of rare CTCs where obtained from the blood sample.

Referring to FIG. 1, Karabacak discloses a conventional microfluidic device 1 including, in order along a flow direction (f) of a blood sample 8, a first microfluidic module 11 for performing the DLD procedure, a second microfluidic module 12 connected to the first microfluidic module 11 for performing the inertial focusing procedure and the magnetophoresis procedure, and two magnetic columns 13.

The first microfluidic module 11 has an inlet channel 111 disposed at an upstream side 101 of the conventional microfluidic device 1, a buffer channel 112, a middle outlet channel 113 disposed between the upstream side 101 and an downstream side 102 of the conventional microfluidic device 1, an upstream reservoir 114 connecting the inlet channel 111, the buffer channel 112 and the middle outlet channel 113, and an array of microposts 115 spacedly disposed in the upstream reservoir 114.

The second microfluidic module 12 has, along the flow direction (f), a micro-channel 121, a downstream reservoir 122, and first and second downstream outlet channels 123, 124 all interconnected. In particular, the first and second downstream outlet channels 123, 124 are disposed respectively proximal to two opposite first and second sides 103, 104 of the conventional microfluidic device 1, and disposed at opposite sides of the downstream reservoir 124. The magnetic columns 13 are respectively disposed on the first and second sides 103, 104 on two opposite sides of the downstream reservoir 124. The middle outlet channel 113 and the micro-channel 121 are respectively proximal to the first and second sides 103, 104.

Before the blood sample 8 enters the conventional microfluidic device 1 through the inlet channel 111, a preparation procedure is performed on the blood sample 8. In the preparation procedure, a plurality of superparamagnetic beads 81 bind with two antibodies CD45 and CD66b such that surfaces of the superparamagnetic beads 81 are covered with the CD45 and CD66b antibodies. Then the blood samples 8 are mixed with the superparamagnetic beads 81 covered with the CD45 and CD66b antibodies, so that the antigens of white blood cells 82 in the blood sample 8 are bound by the CD45 and CD66b antibodies such that the superparamagnetic beads 81 are attached to the white blood cells 82.

When the blood sample 8, which has been through the preparation procedure, enters the first microfluidic module 11 through the inlet channel 111, the microposts 115 in the upstream reservoir 114 deflect and congregate the cells (e.g., the white blood cells 82 and CTCs 83) based on size. Specifically, the DLD procedure performed by the microfluidic module 11 utilizes a critical hydrodynamic diameter (Dc) of the microposts 115. Cells that has a hydrodynamic diameter smaller than Dc of the microposts 115 (e.g., red blood cells 84) are not deflected and flows out of the conventional microfluidic device 1 through the middle outlet channel 113, and cells that have a hydrodynamic diameter larger than Dc of the microposts 115 (i.e., the white blood cells 82 and the CTCs 83) are deflected towards the microchannel 121 of the second microfluidic module 12.

After the DLD procedure separates cells of different sizes, the white blood cells 82 bound to the superparamagnetic beads 81 and the CTCs 83 not attached to the superparamagnetic beads 81 flow along the flow direction (f) to the second microfluidic module 12, and the inertial focusing and magnetophoresis procedures are then performed.

First, the white blood cells 82 attached to the superparamagnetic beads 81 and the CTCs 83 not attached to the superparamagnetic beans 81 are collected in the microchannel 121 and enters the downstream reservoir 122, being affected by the magnetic field $\vec{B}$ generated by the magnetic columns 13 while flowing through the downstream reservoir 122. The white blood cells 82 attached to the superparamagnetic beads 81 experience a force in the magnetic field $\vec{B}$ towards the first side 103 of the microfluidic device 1 such that the white blood cells 82 attached to the superparamagnetic beads 81 flow toward the first downstream outlet channel 123. On the other hand, the CTCs 83 not attached to the superparamagnetic beads 81 are unaffected by the magnetic field $\vec{B}$ and flows towards the second downstream outlet channel 124.

Even though the conventional microfluidic device 1 of Karabacak is able to separate/filter cells of different size through the DLD procedure performed in the first microfluidic module 11 thereof, the microposts 115 in the upstream reservoir 114 of the first microfluidic module 11 can only perform two-dimensional separation/filtration. There remains room for improving the sampling quantity and process efficiency.

SUMMARY

Therefore, the object of the disclosure is to provide a microfluidic device that can alleviate at least one of the drawbacks of the prior art.

According to the disclosure, a microfluidic device is for separating a liquid sample including a plurality of large biological particles and a plurality of small biological particles that are smaller in size than the large biological particles, and for assisting in capturing specifically targeted biological particles from the liquid sample. The microfluidic device includes a lower casing and an upper casing.

The lower casing includes a lower base wall and a pair of lower side walls.

The lower base wall has an upstream side, a downstream side that is distal from the upstream side, a top surface that is formed between the upstream and downstream sides, and a plurality of spaced-apart columns that protrude upwards from the top surface.

Each of the lower side walls extends upwards from the lower base wall and connects the upstream and downstream sides. The lower side walls are spaced by the top surface of the lower base wall and cooperate with the lower base wall to define a lower channel. Each of the lower side walls has a side wall top surface and at least one lower drainage passage that is recessed downwards from the side wall top surface, and that extends from an inner surface of a corresponding one of the lower side walls proximal to the lower channel in an outward direction which is directed oppositely of the lower channel and which is directed obliquely toward the downstream side of the lower base wall.

The upper casing covers the lower casing and includes an upper base wall and a pair of upper side walls.

The upper base wall has an upstream side, and a downstream side respectively corresponding in position to the upstream side and the downstream side of the lower base wall.

The upper side walls extend downwards from the upper base wall and are respectively connected to the lower side walls. The upper side walls cooperate with the upper base wall to define an upper channel. The upper channel and the lower channel cooperatively form a micro-channel.

A first gap between the upper base wall and a column top surface of each of the columns is large enough to permit passage of the large biological particles, and a second gap between any two adjacent ones of the columns is not large enough to permit passage of the large biological particles and is large enough to permit passage of the small biological particles.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
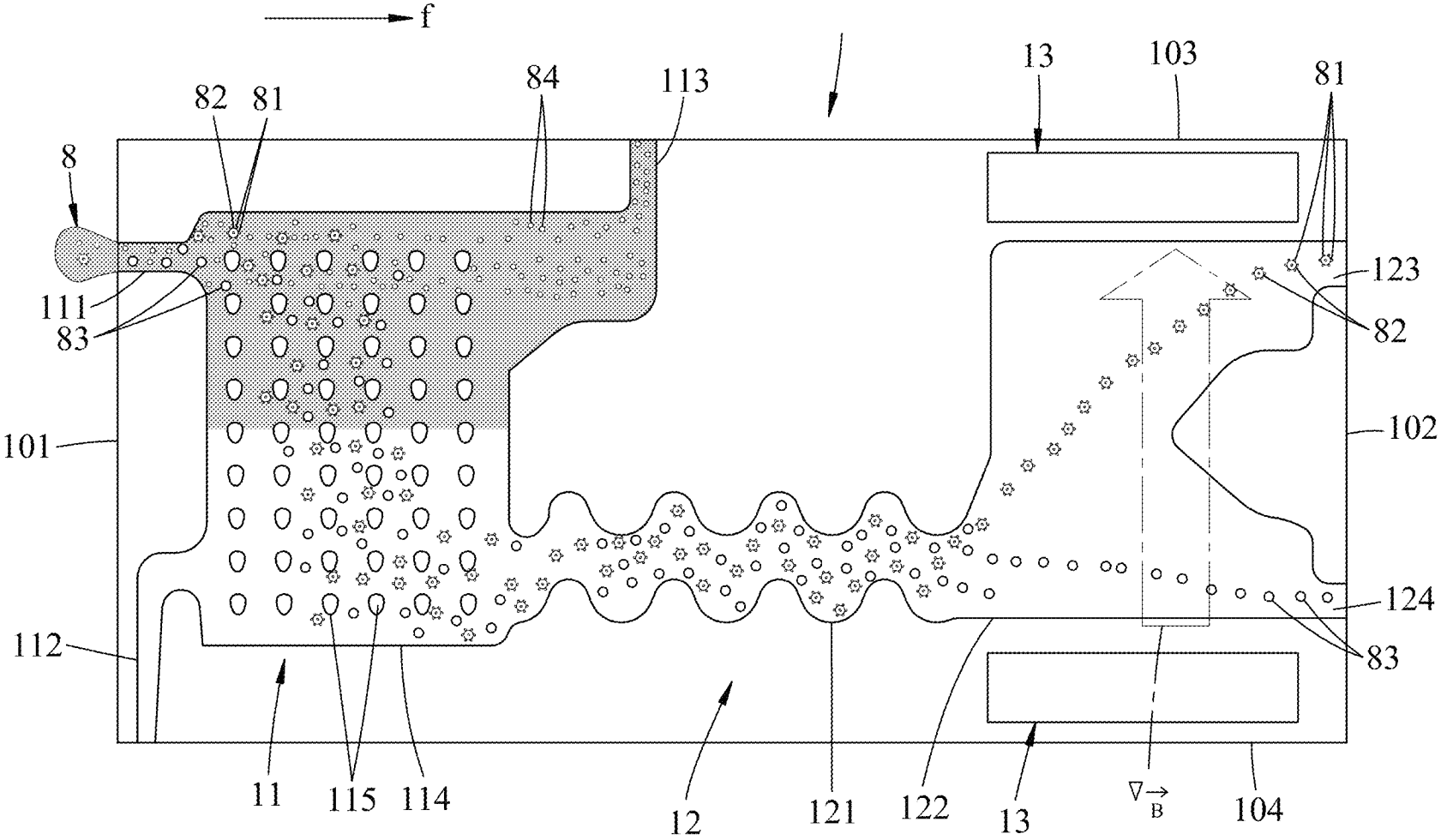
FIG. 1 PRIOR ART
FIG. 1 is a top schematic view of a conventional microfluidic device.

Before the present invention is described in greater detail, it should be noted that where considered appropriate, reference numerals or terminal portions of reference numerals have been repeated among the figures to indicate corresponding or analogous elements, which may optionally have similar characteristics.

Figure 2:
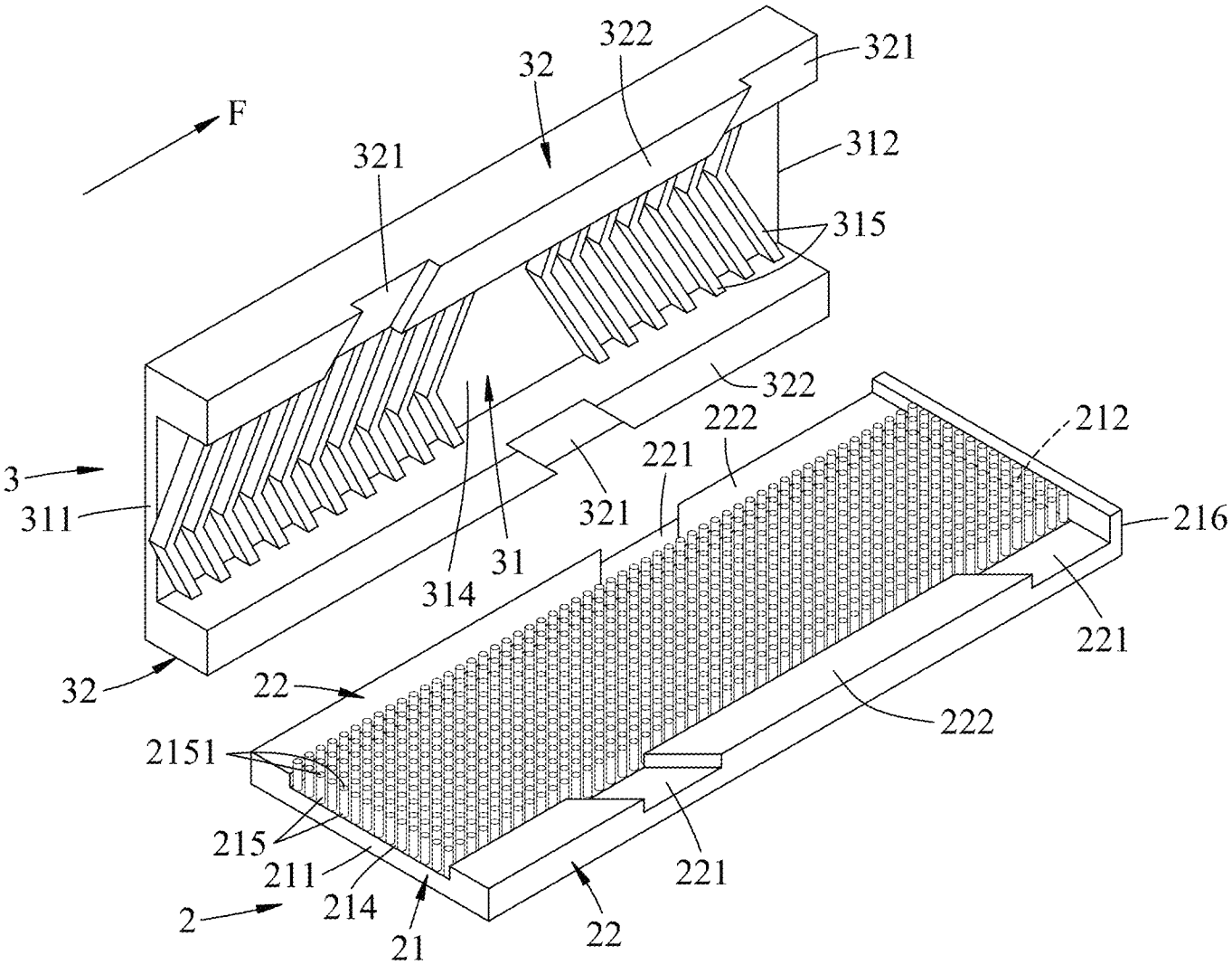
FIG. 2 is an exploded perspective view of an embodiment of a microfluidic device according to the disclosure.
Figure 3:
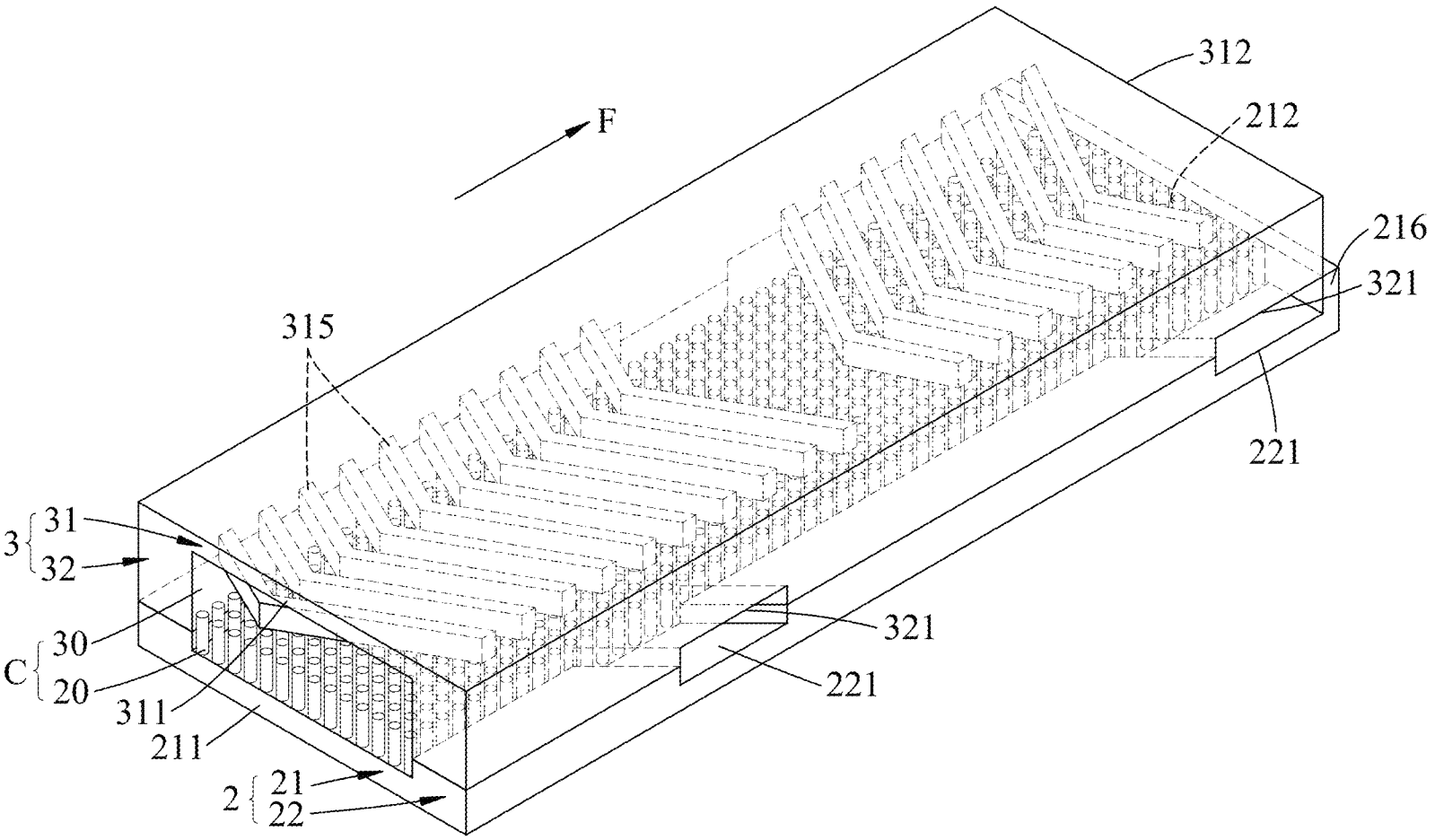
FIG. 3 is a perspective schematic view of the embodiment.
Figure 4:
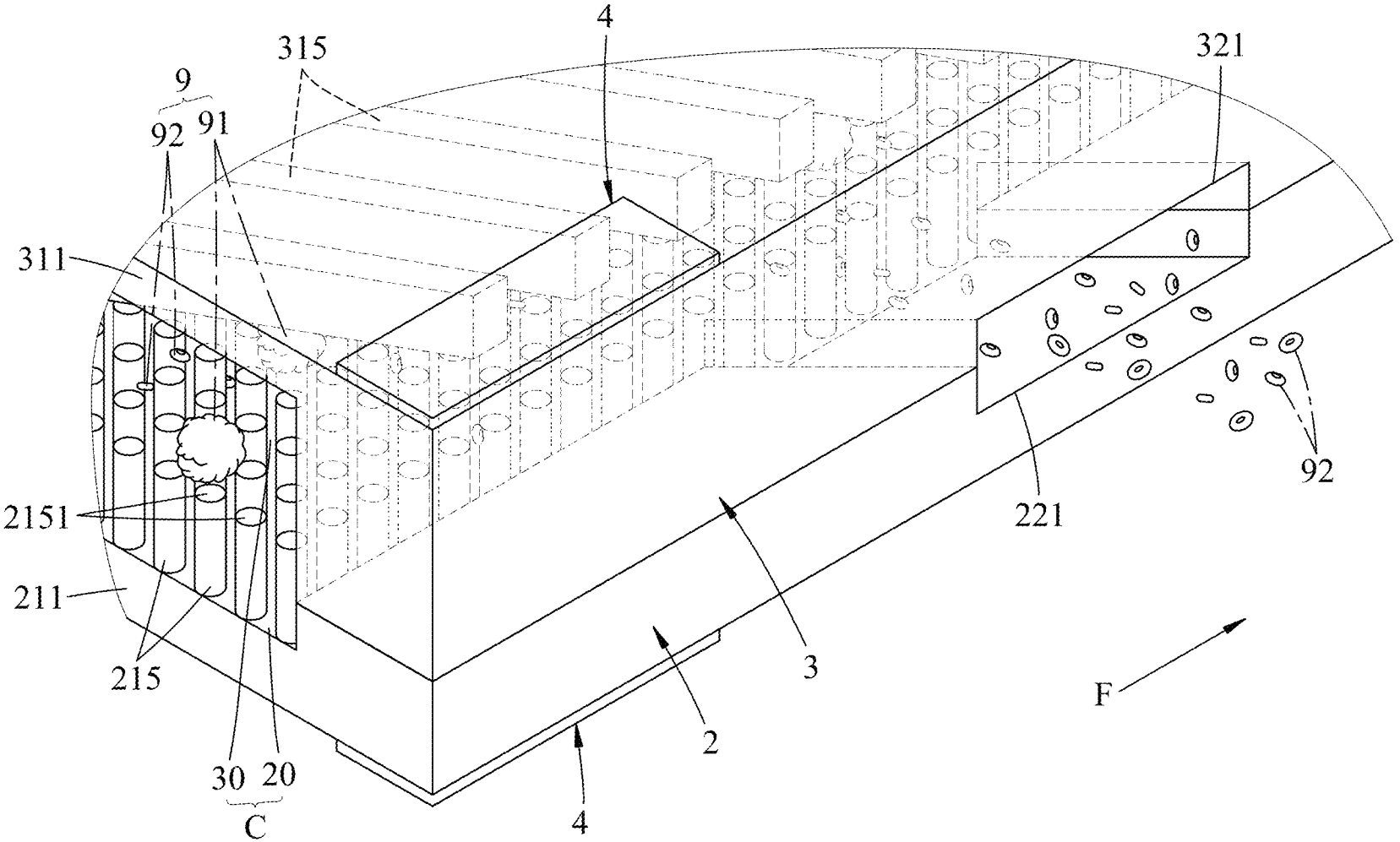
FIG. 4 is a fragmentary magnified perspective and schematic view illustrating connection of a pair of electrodes, a lower casing and an upper casing of the embodiment.

Referring to FIGS. 2 to 4, an embodiment of a microfluidic device according to the disclosure is for separating a liquid sample 9 including a plurality of large biological particles 91 and a plurality of small biological particles 92 that are smaller in size than the large biological particles 91, and for assisting in capturing specifically targeted biological particles from the liquid sample 9. The microfluidic device includes a lower casing 2, an upper casing 3, and a pair of electrodes 4 respectively disposed at the lower and upper casings 2, 3. It should be noted that the liquid sample 9 maybe blood, lymph, urine, saliva, etc. that is obtained from an animal individual or a human individual.

The lower casing 2 includes a lower base wall 21 and a pair of lower side walls 22. The lower base wall 21 has an upstream side 211, a downstream side 212 distal from the upstream side 211, a top surface 214 formed between the upstream and downstream sides 211, 212, and a plurality of spaced-apart columns 215 protruding upwards from the top surface 214. In this embodiment, each of the columns 215 has a plurality of nanoscale holes (not shown). The nanoscale holes of the columns 215 increase the surface area of the columns 215 to increase the possibility of the columns 215 coming into contact with the specifically targeted biological particles. In certain embodiments, each of the columns 215 has a main body connected to the top surface 214 of the lower base wall 21, and an anti-stick coating layer (not shown) formed on the main body. Each of the anti-stick coating layers of the columns 215 is attached with a biotin end group. In this embodiment, each of the anti-stick coating layers may be polyethylene glycol (PEG) that is attached with a biotin-streptavidin complex, i.e. biotinylated PEG. The biotin end group allows the capture of the targeted biological particles. Specifically, the biotin-streptavidin complex will interact with the targeted biological particles flowing past the columns 215 to limit the movement of the targeted biological particles, so that the targeted biological particles adhere to the columns 215. The material of each of the anti-stick coating layers may be selected based on the type or characteristic of the targeted biological particles. In this embodiment, the material is exemplified to be attached with the biotin-streptavidin complex, but may be attached with specific antibodies, antigens, peptide or protein molecules, etc. that limits motion of specific targeted biological particles.

Each of the lower side walls 22 extends upwards from the lower base wall 21 and connects the upstream and downstream sides 211, 212. The lower side walls 22 are spaced by the top surface 214 of the lower base wall 21 and cooperate with the lower base wall 21 to define a lower channel 20. Each of the lower side walls 22 has a side wall top surface 222, and at least one lower drainage passage 221 that is recessed downwards from the side wall top surface 222, and that extends from an inner surface of the lower side wall 22 proximal to the lower channel 20 in an outward direction which is directed oppositely of the lower channel 20 and which is directed obliquely toward the downstream side 212 of the lower base wall 21.

The upper casing 3 covers the lower casing 2 and includes an upper base wall 31 and a pair of upper side walls 32. The upper base wall 31 has an upstream side 311 and a downstream side 312 respectively corresponding in position to the upstream side 211 and the downstream side 212 of the lower base wall 21. The upper side walls 32 extend downwards from the upper base wall 31, are respectively connected to the lower side walls 22, and cooperate with the upper base wall 31 to define an upper channel 30. The upper channel 30 and the lower channel 20 cooperatively form a microchannel (C). Each of the upper side walls 32 has a side wall bottom surface 322, and at least one upper drainage passage 321 that is recessed upwards from the side wall bottom surface 322, and that extends from an inner surface of the upper side wall 32 proximal to the upper channel 30 in an outward direction which is directed oppositely of the upper channel 30 and which is directed obliquely toward the downstream side 312 of the upper base wall 31.

In this embodiment, the lower casing 2 and the upper casing 3 respectively have the lower drainage passage 221 and the upper drainage passage 321. In other embodiments, it may be that only the lower casing 2 has the lower drainage passage 221 or that only the upper casing 3 has the upper drainage passage 321. In this embodiment, the lower casing 2 has three of the lower drainage passages 221 and the upper casing 3 has three of the upper drainage passages 321, the lower drainage passages 221 respectively corresponding in position to the upper drainage passages 321, and each of the lower drainage passages 221 and the respective upper drainage passage 321 are spaced apart from the other lower drainage passages 221 and upper drainage passages 321.

Figure 5:
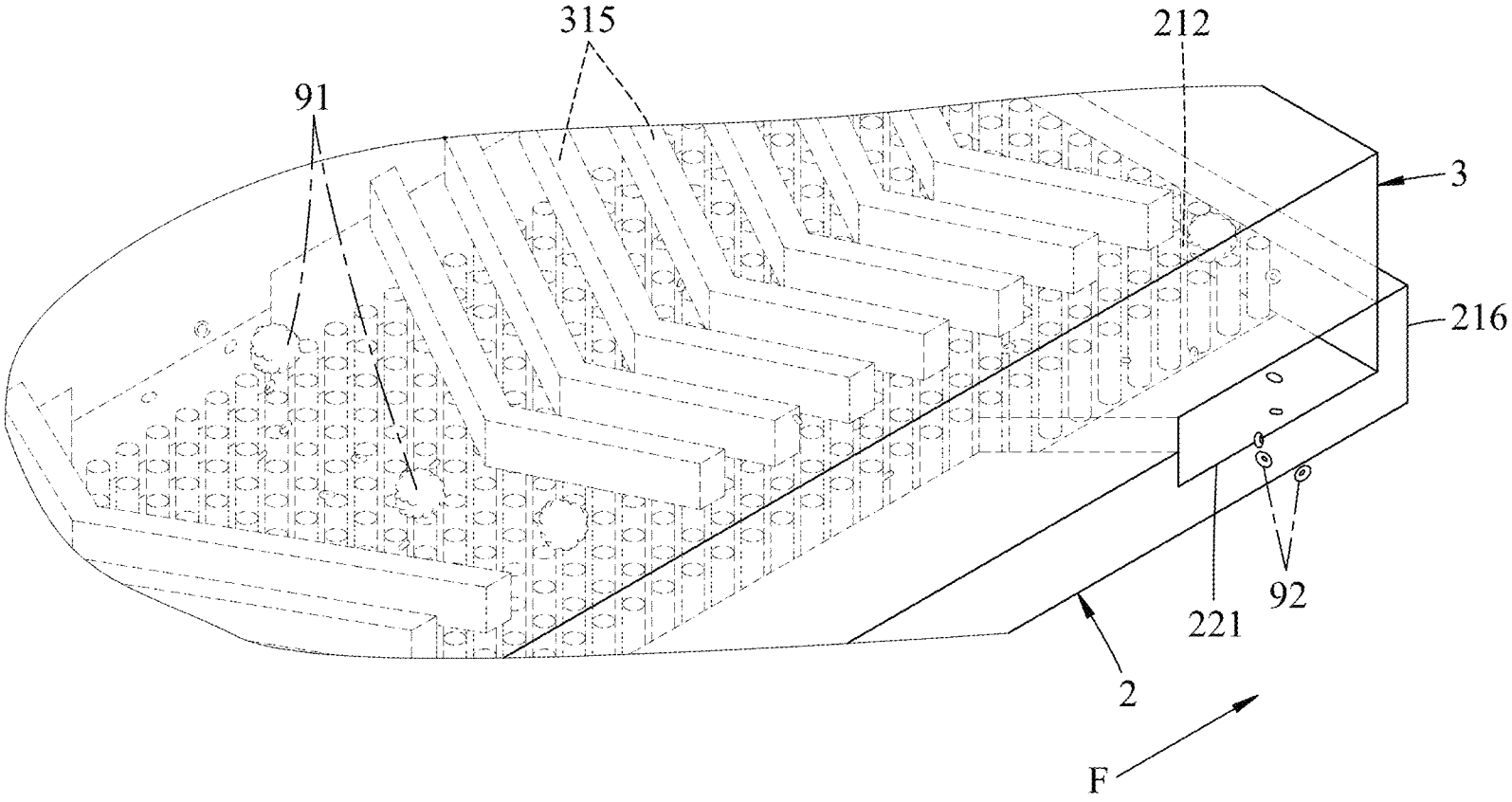
FIG. 5 is another fragmentary magnified perspective and schematic view of the embodiment.
Figure 6:
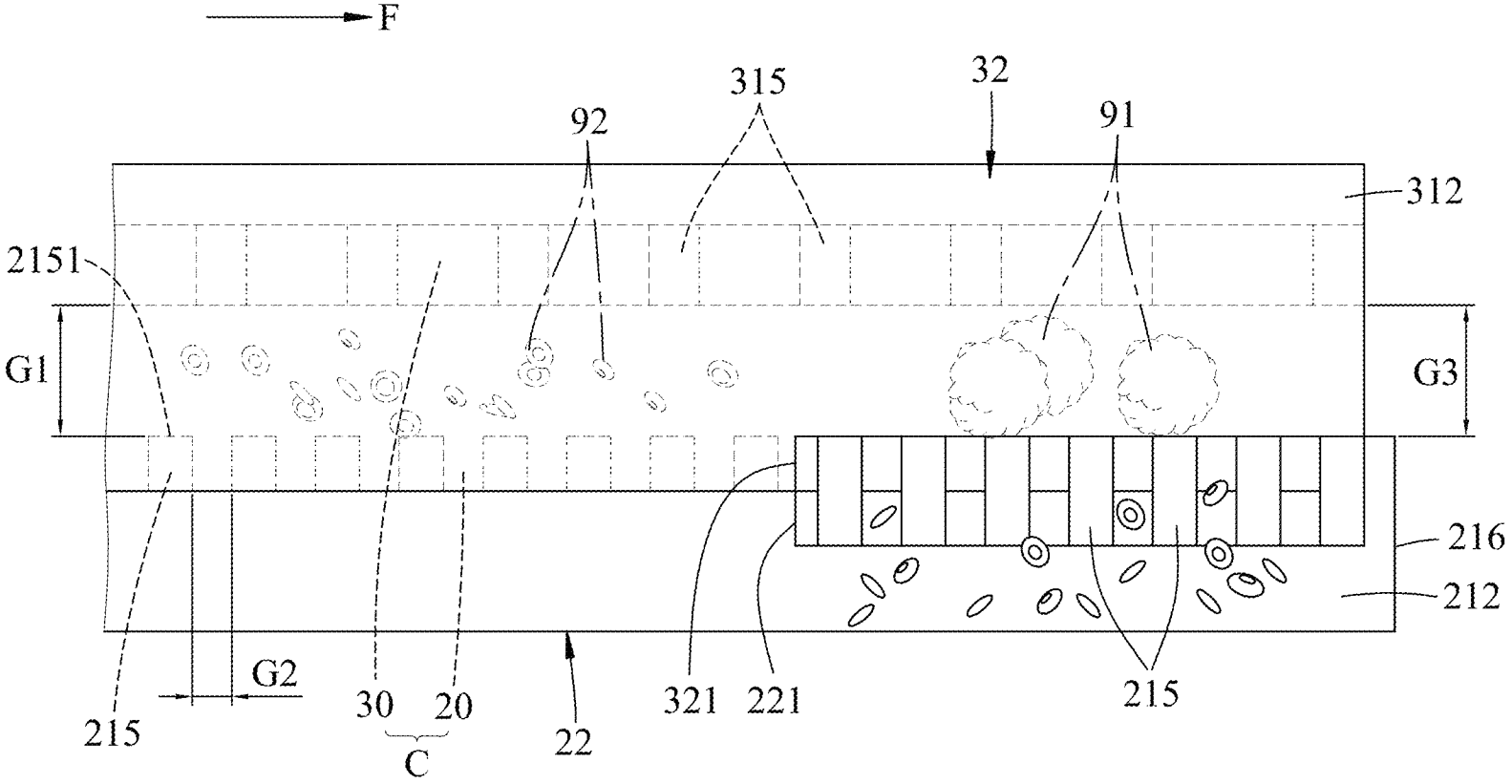
FIG. 6 is a fragmentary schematic side view illustrating the embodiment separating/filtering large and small biological particles.

Referring further to FIGS. 5 and 6, a first gap (G1) between the upper base wall 31 and a column top surface 2151 of each of the columns 215 is large enough to permit passage of the large biological particles 91, and a second gap (G2) between any two adjacent ones of the columns 215 is not large enough to permit passage of the large biological particles 91 and is large enough to permit passage of the small biological particles 92. In this embodiment, the large biological particles 91 may be exemplified as white blood cells having a size between 10 micrometers and 17 micrometers, and the small biological particles 92 may be exemplified as red blood cells having a size between 6 micrometers and 8 micrometers. Correspondingly, in this embodiment, the first gap (G1) is between 10 micrometers and 17 micrometers and the second gap (G2) is between 6 micrometers and 8 micrometers. In this embodiment, each of the columns 215 is substantially cylindrical. A diameter of each of the columns 215 is larger than 1 micrometer and each of the columns 215 has an aspect ratio of 8:1. It should be noted that the first gap (G1) and the second gap (G2) are determined based on the size of the large and small biological particles 91, 92 and are not limited to the aforementioned sizes.

It should be noted that the anti-stick coating layer on the main body of each of the columns 215 may be used for preventing the large biological particles 91 from getting stuck in the first gap (G1) and affecting the process of filtration.

Referring to FIGS. 2, 5, and 6, in certain embodiments, the lower base wall 21 further has a stop flange 216 for stopping the small biological particles 92 from flowing out from the downstream side 212 of the lower channel 20. The stop flange 216 protrudes upwards from the top surface 214 of the lower base wall 21 at the downstream side 212 of the lower base wall 21 to cut off the lower channel 20. In this embodiment, a third gap (G3) between a flange top surface of the stop flange 216 and the upper base wall 31 is large enough to permit passage of the large biological particles 91. The third gap (G3) is substantially equal in size to the first gap (G1).

In this embodiment, the upper base wall 31 further has a bottom surface 314 between the upper side walls 32, and a plurality of guide ribs 315 spaced apart in a flow direction (F) and protruding downward from the bottom surface 314. Each of the guide ribs 315 extend from a middle region of the bottom surface 314 in two directions which are respectively and obliquely directed toward the upper side walls 32 and which are also obliquely directed toward the downstream side 312 of the upper base wall 31. In this embodiment, the first gap (G1) is between the top column surface 2151 of each of the columns 215 and a bottom surface of the guide ribs 315.

Specifically, the upstream sides 211, 311 of the upper and lower base walls 21, 31 form an entrance for the liquid sample 9 to enter the microfluidic device therethrough, and the downstream sides 212, 312 of the upper and lower base walls 21, 31 form an exit for the liquid sample 9 to exit the microfluidic device therethrough. When the liquid sample 9 enter the microchannel (C) through the entrance, the small biological particles 92 are affected by the guide ribs 315 and gravity to sink down to the lower channel 20 and flow along the flow direction (F) through the second gaps (G2) among the columns 215 to exit the microfluidic device from the lower and upper drainage passages 221, 321. The large biological particles 91 is limited due to its size to only flow through the first gap (G1), and is guided by the guide ribs 315 to flow along the flow direction (F) to the exit out of the microfluidic device through the exit at the downstream sides 312, thereby achieving separation of the large biological particles 91 and the small biological particles 92.

The electrodes 4 respectively forms ohmic contact with the lower and upper casings 2, 3, and are operable to adjust a potential difference between the lower and upper casings 2, 3 when a voltage is applied to the electrodes 4, which may improve a capture rate of the specifically targeted biological particles.

In this embodiment, when the liquid sample 9 enter the microchannel (C) through the entrance, the small biological particles 92 are affected by the guide ribs 315 and gravity to sink down to the lower channel 20 and flow through the second gaps (G2) among the columns 215. The small biological particles 92 that have sunk to the lower channel 20 can then exit the microfluidic device from the upper and lower drainage passages 321, 221. The large biological particles 91 are limited to only flow through the upper channel 30 and along the flow direction (F) to the exit out of the microfluidic device at the downstream side 312. Therefore, the microfluidic device of this embodiment utilizes a three dimensional (3D) filtration process, which is less likely to cause blockage in the microfluidic device, and also allows a larger volume the liquid sample 9 to be processed per unit time compared to the conventional microfluidic device.

Figure 7:
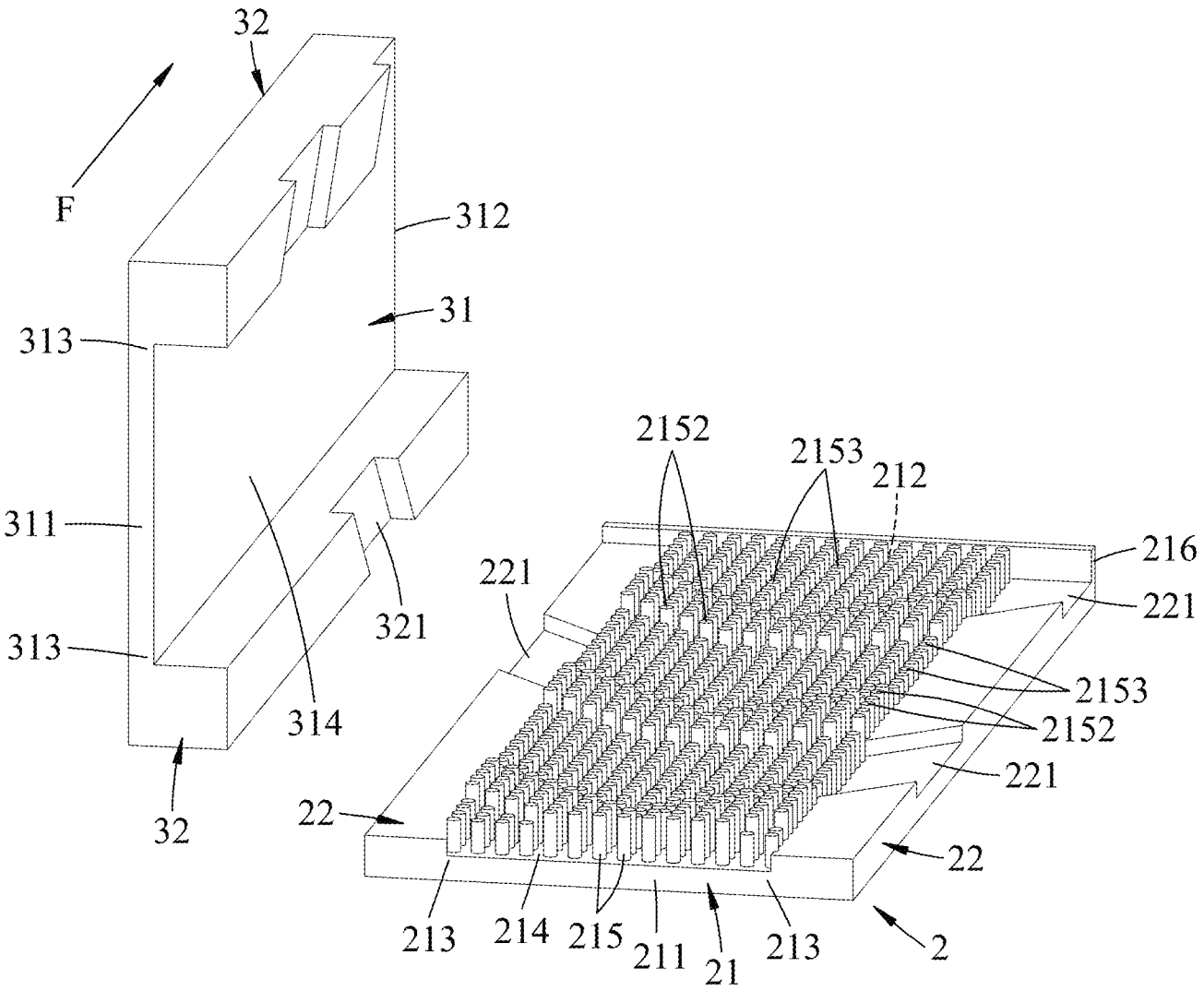
FIG. 7 is an exploded perspective view of a variation of the embodiment.
Figure 8:
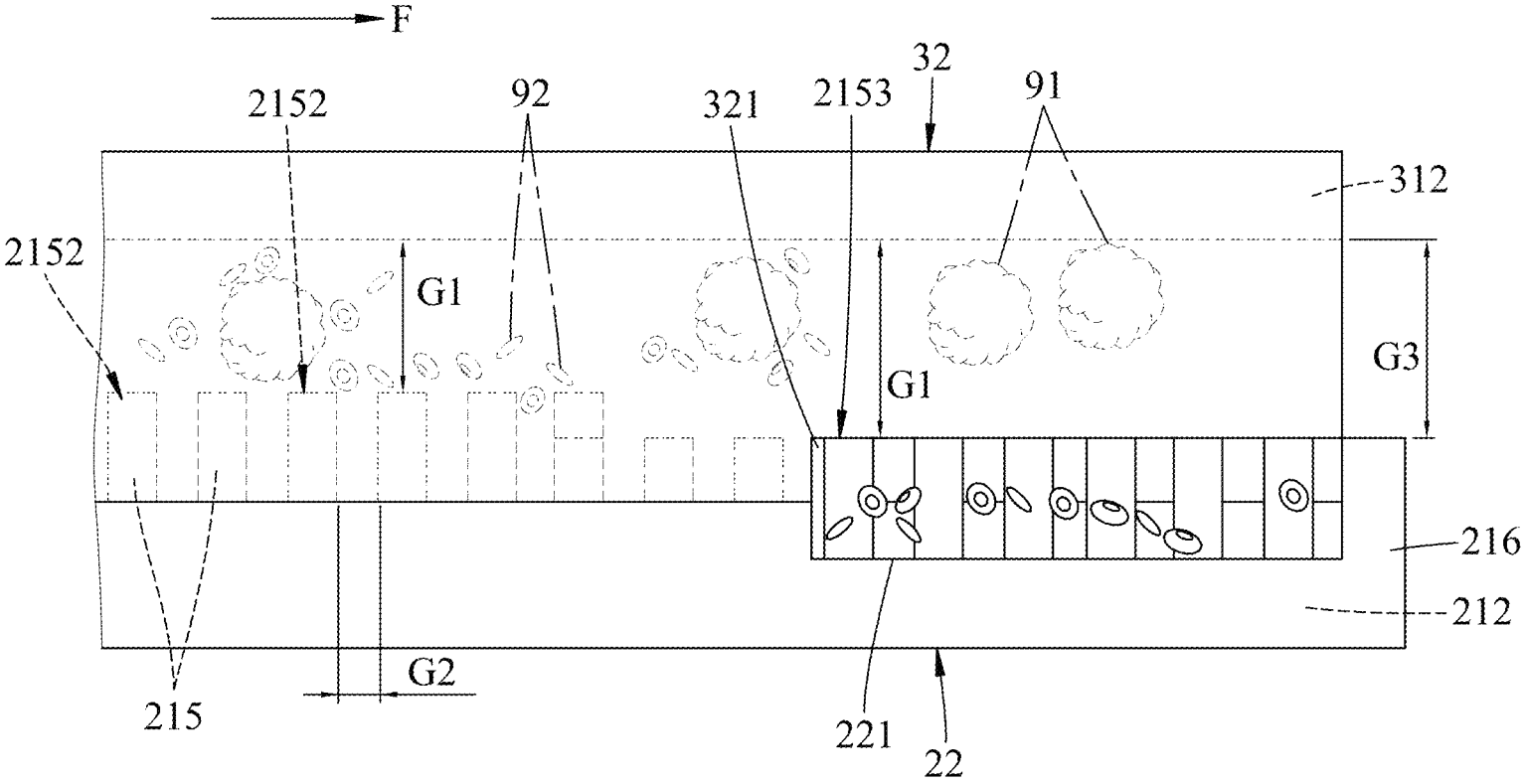
FIG. 8 is a fragmentary schematic side view illustrating the variation of the embodiment separating/filtering large and small biological particles.

Referring to FIGS. 7 and 8, in a variation of the embodiment, the guide ribs 315 are omitted and that the columns 215 include multiple groups of first columns 2152 and multiple groups of second columns 2153. The groups of the first columns 2152 and the groups of the second columns 2153 alternate with each other along the flow direction (F) from the upstream side 211 to the downstream side 212 of the lower base wall 21. Each of the groups of the first and second columns 2151, 2152 forms an array which extends from a middle of the lower base wall 21 in two outward directions that are respectively directed toward the lower side walls 22 and that are obliquely directed to the downstream side 212 of the lower base wall 21. A height of the first columns 2152 of each of the groups is larger than that of the second columns 2153 of each of the groups. In other words, the variation of the embodiment of the microfluidic device utilized two different heights of the columns 215 to achieve the same effect as the guide ribs 315 of the embodiment, with the groups of the first columns 2152 corresponding to the guide ribs 315.

In sum, in the microfluidic device of this disclosure, when the liquid sample 9 enters the micro channel (C), small biological particles 92 can be affect by gravity to gradually sink to the lower casing 2, flow among the columns 215, and exit through the lower and upper drainage passages 221, 321 to allow the capture of specifically targeted biological particles and reduce likelihood of blockage, whereas the large biological particles 91 are limited to the upper channel 30 and flow along the flow direction (F) to exit from the downstream side 312 of the upper channel 30, hence a larger volume of the liquid sample 9 may be processed per unit time.

In the description above, for the purposes of explanation, numerous specific details have been set forth in order to provide a thorough understanding of the embodiments. It will be apparent, however, to one skilled in the art, that one or more other embodiments maybe practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A microfluidic device for separating a liquid sample including a plurality of large biological particles and a plurality of small biological particles that are smaller in size than the large biological particles, and for assisting in capturing specifically targeted biological particles from the liquid sample, the microfluidic device comprising:

a lower casing including a lower base wall having an upstream side, a downstream side that is distal from said upstream side, a top surface that is formed between said upstream and downstream sides, and a plurality of spaced-apart columns that protrude upwards from said top surface, and a pair of lower side walls, each of said lower side walls extending upwards from said lower base wall and connecting said upstream and downstream sides, said lower side walls being spaced by said top surface of said lower base wall, said lower side walls cooperating with said lower base wall to define a lower channel, each of said lower side walls having a side wall top surface and at least one lower drainage passage that is recessed downwards from said side wall top surface, and that extends from an inner surface of said lower side wall proximal to said lower channel in an outward direction which is directed oppositely of said lower channel and which is directed obliquely toward said downstream side of said lower base wall; and an upper casing covering said lower casing and including an upper base wall having an upstream side, and a downstream side respectively corresponding in position to said upstream side and said downstream side of said lower base wall, and a pair of upper side walls extending downwards from said upper base wall and respectively connected to said lower side walls, said upper side walls cooperating with said upper base wall to define an upper channel, said upper channel and said lower channel cooperatively forming a micro-channel;

wherein, a first gap between the upper base wall and a column top surface of each of said columns is large enough to permit passage of the large biological particles, and a second gap between any two adjacent ones of said columns is not large enough to permit passage of the large biological particles and is large enough to permit passage of the small biological particles.

2. The microfluidic device as claimed in claim 1, wherein each of said columns is substantially cylindrical, a diameter of each of said columns being larger than 1 micrometer, each of said column having an aspect ratio of 8:1.

3. The microfluidic device as claimed in claim 1, wherein said lower base wall further has a stop flange protruding from said top surface of said lower base wall at said downstream side of said lower base wall, a third gap between a flange top surface of said stop flange and said upper base wall being large enough to permit passage of the large biological particles, said third gap being substantially equal in size to said first gap.

4. A microfluidic device as claimed in claim 1, wherein said plurality of columns include multiple groups of first columns and multiple groups of second columns, said groups of said first columns and said groups of said second columns alternating with each other along a flow direction from said upstream side to said downstream side of said lower base wall, each of said groups of said first and second columns forming an array which extends from a middle of said lower base wall in two outward directions that are respectively directed toward said lower side walls and that are obliquely directed to said downstream side of said lower base wall, a height of said first columns being larger than that of said second columns.

5. The microfluidic device as claimed in claim 1, wherein said upper base wall further has a bottom surface between said upper side walls, and a plurality of guide ribs spaced apart in the flow direction and protruding downward from said bottom surface, each of said guide ribs extending from a middle region of said bottom surface in two directions which are respectively and obliquely directed toward said upper side walls and which are also obliquely directed toward said downstream side of said upper base wall.

6. The microfluidic device as claimed in claim 1, wherein each of said upper side walls has a side wall bottom surface, and at least one upper drainage passage that is recessed upwards from said side wall bottom surface, and that extends from an inner surface of said upper side wall proximal to said upper channel in an outward direction which is directed oppositely of said upper channel and which is directed obliquely toward said downstream side of said upper base wall.

7. The microfluidic device as claimed in claim 1, wherein each of said columns has a plurality of nanoscale holes.

8. The microfluidic device as claimed in claim 7, wherein each of said columns has a main body connected to said top surface of said lower base wall, and an anti-stick coating layer formed on said main body.

9. The microfluidic device as claimed in claim 8, wherein each of said anti-stick coating layers is attached with a biotin end group.

10. The microfluidic device as claimed in claim 1, further comprising a pair of electrodes respectively disposed at said lower and upper casing.

* * * * *